US007165790B2

(12) United States Patent
Bella et al.

(10) Patent No.: US 7,165,790 B2
(45) Date of Patent: Jan. 23, 2007

(54) DISTORTION RESISTANT SILENT PUSH-PUSH LATCH

(75) Inventors: Joseph J. Bella, Plainfield, IL (US); Steven L. Bivens, Kankakee, IL (US); Gary R. Little, Aurora, IL (US); William J. Olson, Big Sky, MT (US)

(73) Assignee: Illinois Tool Works Inc, Glenview, IL (US)

( * ) Notice: Subject to any disclaimer, the term of this patent is extended or adjusted under 35 U.S.C. 154(b) by 15 days.

(21) Appl. No.: 11/089,077

(22) Filed: Mar. 24, 2005

(65) Prior Publication Data

US 2005/0255737 A1 Nov. 17, 2005

Related U.S. Application Data

(60) Provisional application No. 60/570,955, filed on May 13, 2004.

(51) Int. Cl.
*E05C 19/02* (2006.01)
*E05B 15/02* (2006.01)

(52) U.S. Cl. ..... 292/34; 292/6; 292/302; 292/DIG. 4; 292/DIG. 37; 292/DIG. 38

(58) Field of Classification Search ..... 292/34, 292/6, 19, 137, 165, 302, DIG. 4, DIG. 38, 292/DIG. 60, DIG. 37
See application file for complete search history.

(56) References Cited

U.S. PATENT DOCUMENTS 1,421,197 A * 6/1922 Ferrara ..... 70/82
1,574,023 A * 2/1926 Crompton et al. ..... 292/24
2,967,418 A * 1/1961 Donald ..... 70/71
4,616,861 A * 10/1986 Kurosaki ..... 292/6
4,657,291 A 4/1987 Kurosaki
4,660,871 A * 4/1987 Arakawa et al. ..... 292/81
4,709,949 A * 12/1987 Umezawa et al. ..... 292/6
4,792,165 A * 12/1988 Nishimura ..... 292/19
4,799,718 A * 1/1989 Ing ..... 292/36
5,090,751 A * 2/1992 Kobayashi ..... 292/71
5,217,262 A * 6/1993 Kurosaki ..... 292/6
5,273,328 A * 12/1993 Kurosaki ..... 292/336.3
5,292,158 A 3/1994 Kurosaki
5,516,162 A * 5/1996 Takaishi ..... 292/37
5,670,762 A * 9/1997 Futamura ..... 200/16 D
5,775,748 A * 7/1998 Kurachi ..... 292/341.15
5,915,766 A * 6/1999 Baumeister et al. ... 292/341.15
5,984,381 A 11/1999 Yamagishi
6,056,333 A * 5/2000 Wach ..... 292/145
6,174,003 B1 * 1/2001 Smart ..... 292/109
6,986,535 B2 * 1/2006 Kawamoto et al. .... 292/341.15
7,036,851 B2 * 5/2006 Romig ..... 292/24

FOREIGN PATENT DOCUMENTS

FR 2 622 244 6/1988

* cited by examiner

*Primary Examiner*—Brian E. Glessner
*Assistant Examiner*—Carlos Lugo
(74) *Attorney, Agent, or Firm*—Mark W. Croll; Paul F. Donovan

(57) ABSTRACT

A push-push latch assembly includes opposed gripper arms moved between opened and closed positions upon axial activation of a slide in a housing. The gripper arms have pin disposed in channels of the housing, the channels being angularly oriented to urge the gripper arms to fully closed and fully opened positions and for controlling the separation of the gripper arms for each position of the slide relative to the housing.

19 Claims, 3 Drawing Sheets

DISTORTION RESISTANT SILENT PUSH-PUSH LATCH

CROSS-REFERENCE TO RELATED APPLICATIONS

The present regular U.S. patent application claims the benefits of U.S. Provisional Application Ser. No. 60/570,955 filed May 13, 2004.

FIELD OF THE INVENTION

The present invention relates generally to latch mechanisms, and, more particularly, to latch mechanisms that are both opened and closed with pushing actions.

BACKGROUND OF THE INVENTION

Push-push latch mechanisms are used extensively in many constructions and assemblies, and have received broad acceptance in the automotive industry. Push-push latch latches are known for use on container holders, glove boxes, ashtrays, sunglass bins and other compartments in automobiles. Such mechanisms are used also in the electronics industry for stereos, televisions, video devices and the like which have compartments and things for which it is convenient and/or desirable to using a pushing motion for both latching and unlatching the device.

A push-push latch is operated by pushing the drawer, door, tray or other device both to open and close the object. For example, a cup holder is released from a closed or stored position by pushing it inwardly in its mounting. The inward movement of the cup holder releases the holder from its latching mechanism, allowing it to spring outwardly for use. From the extended or exposed position for use, the holder is returned to a stored condition by again pushing the holder inwardly in its mounting, causing the latch to engage the holder, retaining it in the stored position.

Push-push latches have achieved acceptance for many uses. In some circumstances however, some inadequacies have been realized. An accepted design for a push-push latch mechanism includes gripper arms that close around similarly shaped striker pieces of the object, when the latch is closed. Upon opening, the gripper arms disengage from the striker, which slides past the gripper arms. A problem can arise if the arms become deformed. When the latch remains closed for an extended period of time, the flexible gripper arms can become deformed permanently, to not open completely. Such deformation, referred to as "set" is accelerated in higher heat environments such as in heat generating electronic devices, automobiles during hot weather, etc. If the arms do not open completely, the arms may catch the striker as it is released from the latch. The result can be noisy operation of the latch, a noticeable delay in operation of the latch, or even a complete failure of the latch to open.

What is needed in the art is a push-push latch that works easily and reliably for an extended period of use.

SUMMARY OF THE INVENTION

The present invention provides a push-push latch mechanism having gripper arms that are slidingly connected to slots in the housing that force the arms to fully opened positions each time the mechanism is opened.

In one aspect thereof, the present invention provides a push-push latch assembly with a housing and a slide axially translatable in the housing. One of the housing and the slide defines a circuitous path having first and second pockets for opened and closed positions of the latch assembly. A follower is operatively associated with the housing and the slide for traversing the path and alternately settling in the first and second pockets upon successive axial activations of the slide relative to the housing. One of the housing and the slide has a gripper that is alternately opened and closed by successive axial activations of the slide relative to the housing. The other of the housing and the slide defines a channel, and a pin on the gripper slides in the channel as the gripper is moved between closed and opened positions.

In another aspect thereof, the present invention provides a push-push latch assembly with a housing and a slide movable relative to the housing between inward and outward positions. A latch mechanism alternately captures the slide in the inward and outward positions. Opposed first and second gripper arms on the slide having closed and opened positions determined by the position of the slide relative to the housing. A positional control between the housing and the gripper arms controls separation of the gripper arms for any position of the slide relative to the housing.

In a still further aspect thereof, the present invention provides a push-push latch assembly with a housing and a slide movable relative to the housing between inward and outward positions. A latch mechanism alternately captures the slide in the inward and outward positions. The latch mechanism includes a circuitous path defined in one of the slide and the housing. The circuitous path has first and second pockets for opened and closed positions. A slot is defined in the other of the housing and the slide. A follower is operatively associated with the housing and the slide and includes a pin for traversing the path and alternately settling in the first and second pockets upon successive axial activations of the slide relative to the housing. The follower has a portion thereof disposed in the slot; and the slot is defined partly by a biasing element for squeezing the portion of the follower in the slot.

In a still further aspect thereof, the present invention provides a push-push latch assembly with a housing having a wall defining a slot and first and second channels. A slide has a body axially translatable in the housing. The body has a recessed area defining a circuitous path having first and second pockets for opened and closed positions of the latch assembly. A follower is operatively associated with the housing and the slide for traversing the path and alternately settling in the first and second pockets upon successive axial activations of the slide relative to the housing. The follower has portions thereof traversing the circuitous path and sliding in the slot upon axial activations of the slide relative to the housing. First and second opposed gripper arms are connected flexibly to the body. First and second pins extend from the first and second gripper arms, respectively, and are contained slidably in the first and second channels, respectively.

Other features and advantages of the invention will become apparent to those skilled in the art upon review of the following detailed description, claims and drawings in which like numerals are used to designate like features.

Figure 1:
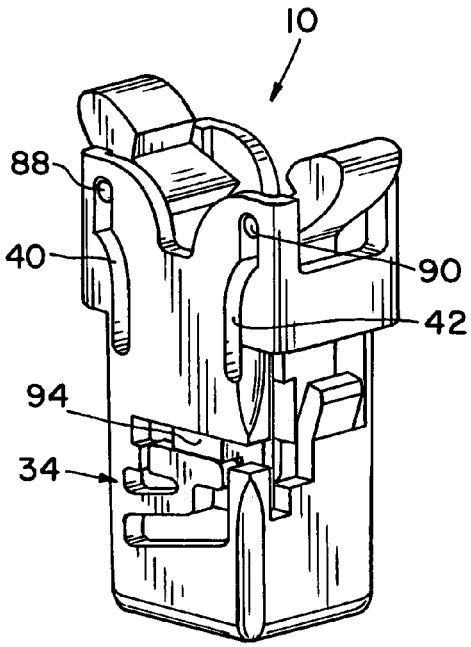
FIG. 1 is a perspective view of a push-push latch mechanism of the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, numeral 10 designates a push-push latch assembly in accordance with the present invention. Latch assembly 10 includes a housing 12 and a slide 14 disposed in and axially translatable relative to housing 12. A follower 16 interconnects housing 12 and slide 14 and is directed by formations in each of housing 12 and slide 14 to form a latch mechanism for directing and controlling movement of said slide relative to said housing, as will be described more fully hereinafter.

Figure 2:
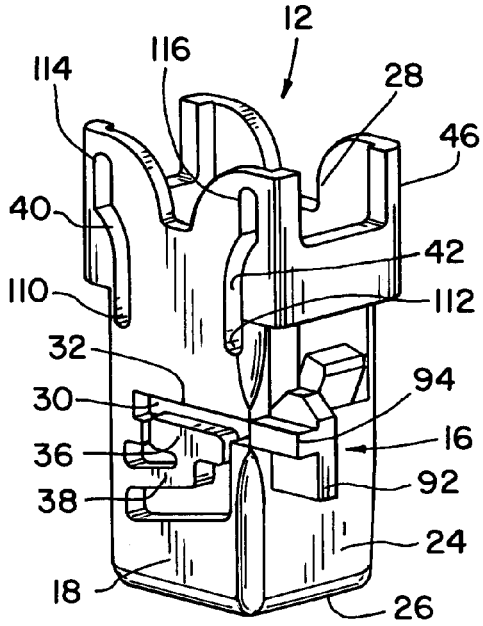
FIG. 2 is a perspective view of the housing for the latch mechanism shown in FIG. 1, illustrating the housing as manufactured and before assembly.
Figure 3:
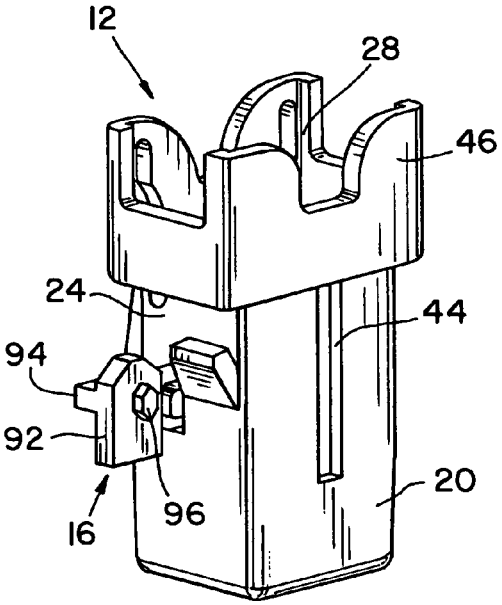
FIG. 3 is a perspective view of the housing for the latch mechanism shown in FIG. 1 illustrating sides of the housing not shown in FIG. 2.
Figure 4:
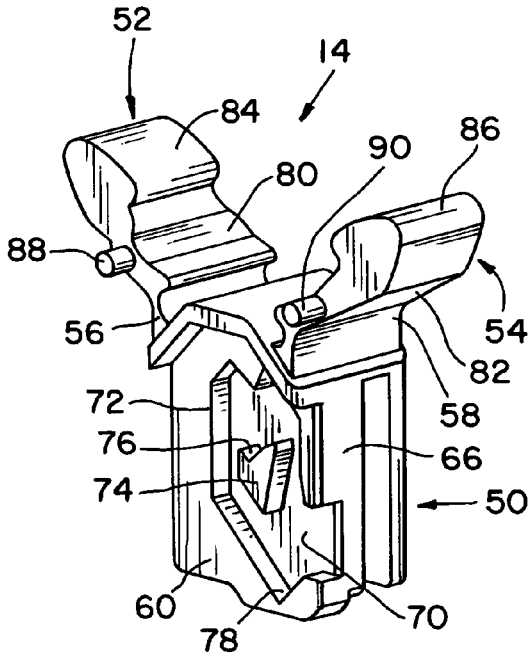
FIG. 4 is a perspective view of the slider mechanism for the latch shown in FIG. 1.
Figure 5:
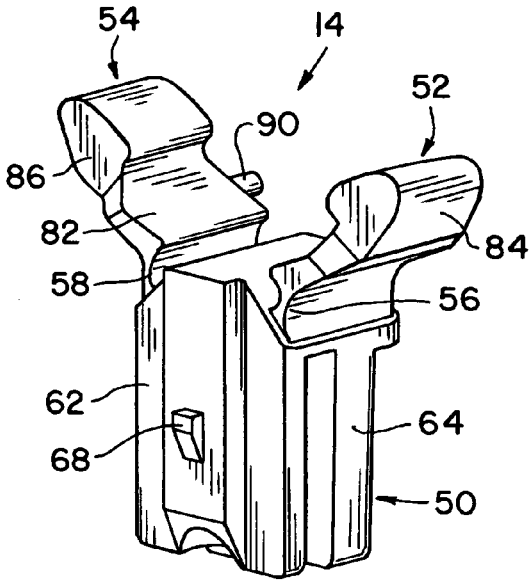
FIG. 5 is a perspective view of the slider mechanism shown in FIG. 4, illustrating sides of the mechanism not shown in FIG. 4.

Latch assembly 10 can be made of a variety of materials, and various plastics are suitable materials. As illustrated in FIGS. 2 and 3, for manufacturing and handling efficiency, follower 16 can be molded together with housing 12, connected thereto by a thin web that is fractured when housing 12, slide 14 and follower 16 are assembled. As will be more fully described hereinafter, follower 16 is separate from each housing 12 and slide 14, but is directed in movement by structures on each of housing 12 and slide 14.

For ease of description herein, terms such as front, back, top, bottom, side and the like will be used for describing relationships of the various elements of latch assembly 10 with respect to each other. It should be understood, however, that latch assembly 10 can work in a variety of positions and orientations and need not be used only in the orientation shown in FIG. 1. Accordingly, terms such as front, back, top, bottom, side and the like, and directional descriptions such as up, down, right and left are used only with respect to the orientation shown in the drawings, and should not be understood as limiting the manner in which the present invention can be used. For example, latch assembly 10 can be used in positions inverted 180° from the orientation shown in FIG. 1 or can be rotated right, left, front or back from the orientation shown in FIG. 1.

Housing 12 is a partly enclosed structure having multiple walls including a front 18, a back 20 in spaced relation thereto and opposed sides 22 and 24 between front 18 and back 20. Housing 12 further includes a bottom 26. A top end 28 of housing 12 is open for receiving slide 14 therein. Front 18 defines a slot 30 formed between a substantially horizontal edge 32 and a biasing element 34. Biasing element 34 includes a wall 36 defining a side of slot 30 cantilevered on a spring arm 38 of front 18. Wall 36 is otherwise separate from front 18 except for its connection to spring arm 38 from front 18. Spring arm 38 is an elongated element connected at one end to the main extent of front 18 and at the other end to wall 36. Front 18 further defines first and second channels 40, 42, the shape and length of which will be described in further detail hereinafter. Back 20 defines a substantially axially oriented groove 44.

In the exemplary embodiment shown, housing 12 also includes a collar 46 near top 28. Collar 46 and other structures (not shown) can be used for facilitating installation of housing 12 and thereby latch assembly 10 in a device, mechanism or structure in which it is to be used.

Slide 14 includes a main body 50 and first and second gripper arms 52, 54, respectively. Gripper arms 52, 54 are connected to body 50 by thinned hinge-like segments 56, 58. Gripper arms 52, 54 can pivot toward and away from each other, bending at segments 56, 58. Body 50, gripper arms 52, 54 and segments 56, 58 are formed as a monolithic body of material.

Body 50 is shaped to fit relatively snugly in housing 12 while being able to slide axially therein. Body 50 includes a front 60, a back 62 and sides 64, 66 on opposite edges of front 60 and back 62. Body 50 is shaped to slide smoothly and linearly relative to housing 12 and includes a projection 68 on back 62 to be received in and directed by groove 44.

Front 60 includes a recessed area 70 defined by a somewhat heart-shaped wall 72. Within recessed area 70 a shaped nest 74 is provided. Together with nest 74, and specifically the outer surface thereof, wall 72 defines a circuitous path within recessed area 70. Follower 16 is operatively associated with the circuitous path formed by wall 72 and nest 74, as will be described in greater detail hereinafter. Within the circuitous path formed on front 60, nest 74 defines a first pocket 76 for engaging follower 16 when latch assembly 10 is in a closed position. A lower portion of wall 72 defines a second pocket 78 for confining follower 14 when latch assembly 10 is in an opened position.

Gripper arms 52, 54 have bases 80, 82, respectively, connected to segments 56, 58, respectively. Cap portions 84, 86 of gripper arms 52, 54 define inward projections for securing therebetween a striker plate (not shown) of the device to be held by latch assembly 10. On front surfaces thereof, gripper arms 52, 54 have pins 88, 90 projecting therefrom. Pins 88, 90 are received in first and second channels 40, 42 of housing 12.

Follower 16 is disposed between front 60 of slide 14 and an inner surface of front 18 of housing 12. Follower 16 include a body 92 having a slide bar 94 on the front there of and a pin 96 on the back thereof. Slide bar 94 is disposed in slot 30, and pin 96 extends into recessed area 70, to traverse the circuitous path formed by wall 72 and net 74. Slot 30 is cut slightly more narrow than the width of slide bar 94, so that biasing element 34 is slightly deflected when slide bar 94 is inserted into slot 30. Biasing element 34 thereby urges slide bar 94 against edge 32.

Figure 6:
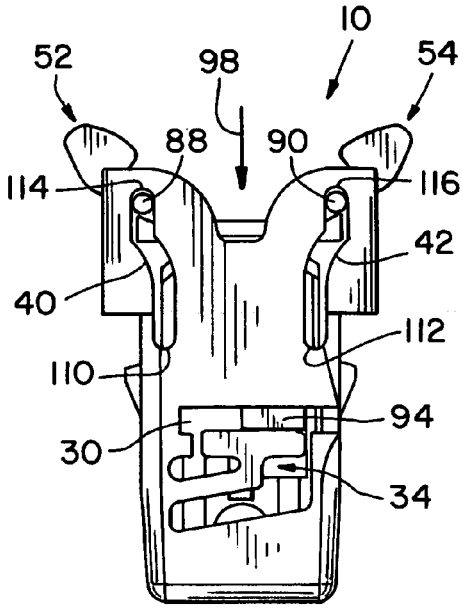
FIG. 6 is a plan view of the latch mechanism in an open position.
Figure 7:
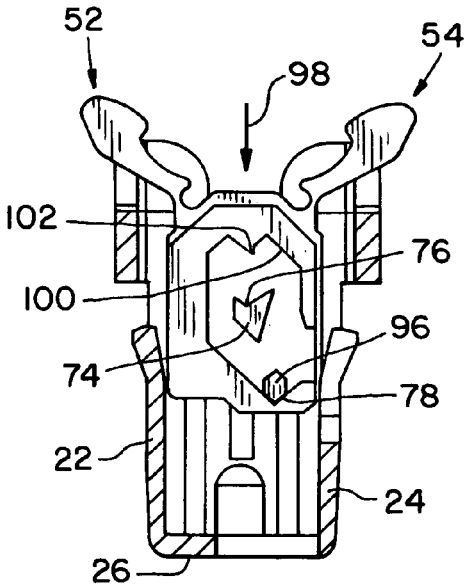
FIG. 7 is a cross-sectional view of the latch mechanism shown in FIG. 6.
Figure 8:
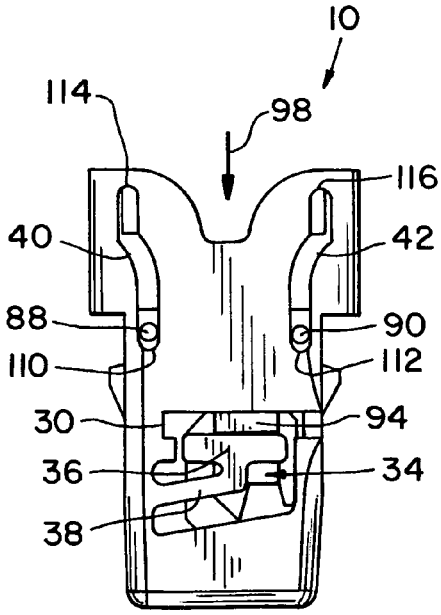
FIG. 8 is a plan view of the latch mechanism in the actuated position.
Figure 9:
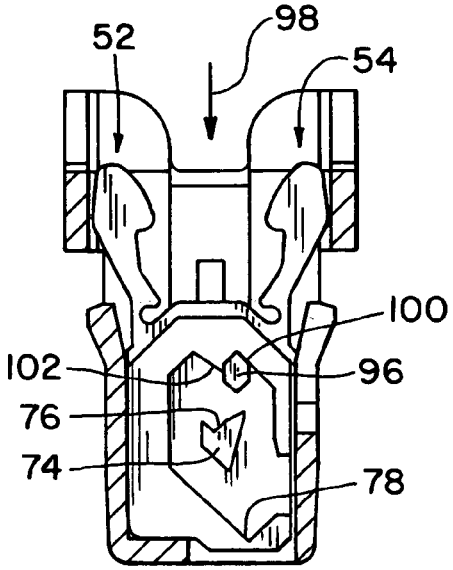
FIG. 9 is a cross-sectional view of the latch mechanism shown in FIG. 8.
Figure 10:
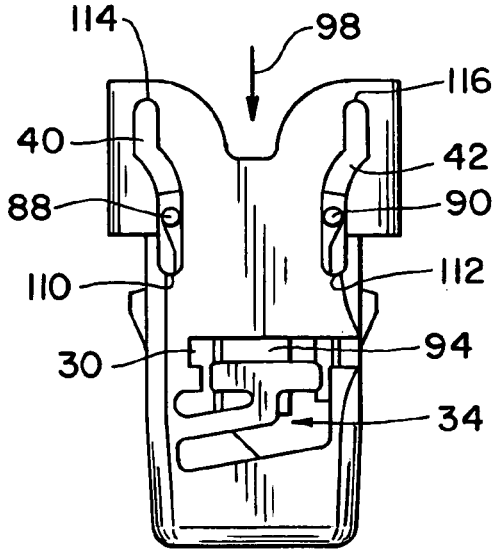
FIG. 10 is a perspective view of the latch mechanism illustrated in a closed position.
Figure 11:
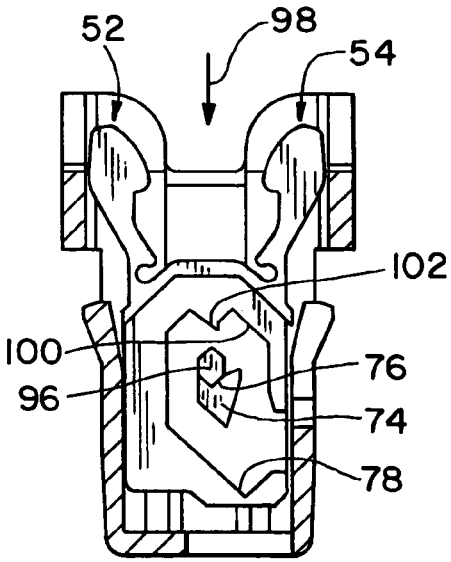
FIG. 11 is a cross-sectional view of the latch mechanism shown in FIG. 10.

Operation of latch assembly 10 is described with reference to FIGS. 6, 7, 8, 9, 10 and 11, wherein FIGS. 6, 8 and 10 are front views of latch assembly 10 in opened, actuated and latched conditions, respectively. FIGS. 7, 9 and 11 are cross-sectional views of the latch configurations illustrated in FIGS. 6, 8 and 10, respectively.

Latch assembly 10 is assembled wit slide 14 in housing 12 such that projection 68 is confined in groove 44. Follower 16 is disposed between housing 12 and slide 14 such that slide bar 92 is contained within slot 30 and protrusion 96 is allowed to traverse the circuitous path formed by wall 72 and net 74. Thus, protrusion 96 extends into recessed are 70. Pins 88,90 of gripper arm 92,94 are positioned within first and second channels 40 and 42, respectively. A aping (not shown) is provided in housing 12, between bottom 26 and body 50 of slide 14, to urge slide 14 outwardly from housing 12.

Latch 10 is actuated when force is exerted against body 50, as indicated by arrow 98. It should be understood that force applied at arrow 98 is from a striker assembly of a device to be held in latch assembly 10. For example, if assembly 10 is used to hold a door (not shown) of a compartment, a striker (not shown) on the door is pushed against body 50 when force is applied against the door. The door is pushed both when the door is being opened and when the door is being closed. The start of either action begins with force applied against body 50, as indicated by arrow 98.

When latch assembly 10 is in an opened position, protrusion 96 is contained within opened pocket 78 (FIG. 7). As slide 14 is pushed downwardly from the position shown in FIGS. 6 and 7, wall 72 encounters protrusion 96 along a segment 100 of wall 72. Segment 100 is angularly oriented such that follower 16 is directed to the left as shown in FIG. 7, until protrusion 96 encounters a redirector 102 of wall 72. From the position illustrated in FIGS. 8 and 9, with protrusion 96 engaged between segment 100 and redirector 102, inward force on slide 14 is terminated, as it will have "bottomed out", not being able to be pushed further. Upon release, slide 14 moves slightly outward until protrusion 96 settles into pocket 76 (FIGS. 10 and 11). From the position illustrated in FIG. 11, inward force against slide 14 causes redirector 102 to engage protrusion 96 on the opposite side from that shown in FIG. 9. As slide 14 is released, it moves outwardly with protrusion 96 passing to the left of nest 74, engaging against wall 72 and settling in pocket 78 as illustrated FIGS. 6 and 7.

Pins 88, 90 are contained within first and second channels 40, 42, and move there along as slide 14 moves inwardly and outwardly, thereby providing a positional control for gripper arms 52, 54 for any position of slide 14 with relative to housing 12. Channels 40, 42 are of appropriate length and orientation such that arms 52, 54 are moved fully between the closed and opened positions, with the separation therebetween being controlled for all positions of slide 14 relative to housing 12. Accordingly, inner ends 110, 112 of channels 40, 42 are closer to each other than are outer ends 114, 116 of channels 40, 42, respectively. Pins 88, 90 directed in channels 40, 42 cause full movement of gripper arms 52, 54 even after prolonged inactivity when plastic set would occur and limit natural movement of the arms. Since the arms are forced to fully opened or fully closed positions with each activation of latch assembly 10, hang-up of gripper arms 52, 54 on a striker plate (not shown) in a device held by latch assembly 10 does not occur. The movement of each gripper arm 52, 54 is directed by the movement of pins 88, 90 in channels 40, 42, as shown by the comparative positions of pins 88, 90 relative to channels 40, 42 illustrated in FIGS. 6, 8 and 10.

Biasing element 34 pinches slide bar 92 in slot 30as slide bar 92 slides back and forth in slot 30. The pinching of slide bar 92 in slot 30 is such that follower 16 does not move if latch assembly 10 is tilted, turned or inverted. Thus, protrusion 96 remains in either pocket 76 or pocket 78, even if the item on which latch assembly 10 is installed is jostled, moved, rotated, inverted or the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A push-push latch assembly comprising:

a housing;

a slide axially translatable in said housing;

said slide defining a circuitous path having first and second pockets for opened and closed positions of said latch assembly;

a follower operatively associated with said housing and said slide for traversing said path and alternately settling in said first and second pockets upon successive axial activations of said slide relative to said housing;

a gripper that is alternately opened and closed by successive axial activations of said slide relative to said housing; and a pin on said gripper for sliding movement with respect to one of said housing and said slide as said gripper is moved between closed and opened positions.

2. The latch assembly of claim 1, said gripper including first and second opposed gripper arms.

3. The latch assembly of claim 2, said first gripper arm including said pin and said second gripper arm including a second pin, said first and second gripper arms provided on said slide, and said housing including a first channel and a second channel, said first and second channels receiving said first and second pins.

4. The latch assembly of claim 3, said housing defining a slot, and said follower being slidably held in said slot while traversing said path.

5. The latch assembly of claim 4, said slot having a biasing element for pinching said follower in said slot.

6. The latch assembly of claim 1, said housing defining a slot, and said follower being slidably held in said slot while traversing said path.

7. The latch assembly of claim 6, said slot having a biasing element for pinching said follower in said slot.

8. A push-push latch assembly comprising:

a housing;

a slide movable relative to said housing between inward and outward positions relative to said housing;

a latch mechanism alternately capturing said slide in said inward and outward positions;

opposed first and second flexible gripper arms on said slide having closed and opened positions determined by the position of said slide relative to said housing; and a positional control between said housing and said gripper arms controlling separation of said gripper arms for any position of said slide relative to said housing, said positional control including first and second channels defined in said housing, and first and second pins on said first and second gripper arms, respectively, said first and second pins being disposed in said first and second channels, respectively.

9. The push-push latch assembly of claim 8, said channels each having inner and outer ends, and said inner ends being closer to each other than said outer ends are to each other.

10. A push-push latch assembly comprising:

a housing;

a slide movable relative to said housing between inward and outward positions relative to said housing;

a latch mechanism alternately capturing said slide in said inward and outward positions;

said latch mechanism including a circuitous path, said circuitous path having first and second pockets for opened and closed positions;

a slot defined in one of said housing and said slide;

a follower operatively associated with said housing and said slide, said follower including a pin for traversing said path and alternately settling in said first and second pockets upon successive axial activations of said slide relative to said housing, said follower having a portion thereof disposed in said slot; and said slot being partly defined by a biasing element for squeezing said portion of said follower in said slot.

11. The push-push latch assembly of claim 10, said slot having a portion thereof supported on a spring arm.

12. The latch assembly of claim 11, said slot disposed in said housing, said circuitous path defined in said slide and said follower including a body having a slide bar on one side thereof disposed in said slot and a pin on an opposite side thereof disposed in said path.

13. The latch assembly of claim 10, said slot disposed in said housing, said circuitous path defined in said slide and said follower including a body having a slide bar on one side thereof disposed in said slot and a pin on an opposite side thereof disposed in said path.

14. A push-push latch assembly comprising:

a housing having a wall defining a slot and first and second channels;

a slide having a body axially translatable in said housing;

said body having a recessed area defining a circuitous path having first and second pockets for opened and closed positions of said latch assembly;

a follower operatively associated with said housing and said slide for traversing said path and alternately settling in said first and second pockets upon successive axial activations of said slide relative to said housing, said follower including portions thereof traversing said circuitous path and sliding in said slot upon axial activations of said slide relative to said housing;

first and second opposed gripper arms flexibly connected to said body; and first and second pins extending from said first and second gripper arms, respectively, said pins being slidably contained in said first and second channels, respectively.

15. The push-push latch assembly of claim 14, said channels each having inner and outer ends, and said inner ends being closer to each other than said outer ends are to each other.

16. The push-push latch assembly of claim 15, said slot having a wall thereof supported on a spring arm, and said follower having a slide bar pinched in said slot.

17. The latch assembly of claim 14, said slot having a biasing element for pinching said follower in said slot.

18. The push-push latch assembly of claim 14, said follower including a body having a pin projecting from one side thereof and a slide bar projecting from an opposite side thereof.

19. The push-push latch assembly of claim 18, said follower being a piece separated from said housing.

* * * * *